US008313334B2

(12) United States Patent
Ruland

(10) Patent No.: US 8,313,334 B2
(45) Date of Patent: Nov. 20, 2012

(54) PEDESTAL GROUND CONNECTOR

(75) Inventor: Rodd R. Ruland, Amherst, NH (US)

(73) Assignee: Hubbell Incorporated, Shelton, CT (US)

( * ) Notice: Subject to any disclaimer, the term of this patent is extended or adjusted under 35 U.S.C. 154(b) by 196 days.

(21) Appl. No.: 12/807,135

(22) Filed: Aug. 27, 2010

(65) Prior Publication Data

US 2011/0065333 A1 Mar. 17, 2011

Related U.S. Application Data

(60) Provisional application No. 61/276,374, filed on Sep. 11, 2009.

(51) Int. Cl.
*H01R 11/03* (2006.01)

(52) U.S. Cl. ..... 439/100; 439/792

(58) Field of Classification Search ..... 439/100, 439/728, 792, 817, 803
See application file for complete search history.

(56) References Cited

U.S. PATENT DOCUMENTS

| | | | | |
|---|---|---|---|---|
| 774,099 | A | 11/1904 | Narsh | |
| 846,202 | A | 3/1907 | Harrah | |
| 1,052,234 | A | 2/1913 | Gaertner | |
| 1,056,173 | A | 3/1913 | Higgin | |
| 2,107,594 | A | 2/1938 | Bicknese | 174/156 |
| 2,364,419 | A | 12/1944 | Barnes | 256/58 |
| 2,915,268 | A | 12/1959 | Wrobel | |
| 2,942,898 | A | 6/1960 | Matthysse | |
| 3,075,166 | A | 1/1963 | Peek | |
| 3,129,994 | A | 4/1964 | Harmon et al. | 439/100 |
| 3,435,126 | A | 3/1969 | Hamilton | 174/78 |
| 3,861,771 | A | 1/1975 | Cornell | 339/95 R |
| 3,864,005 | A * | 2/1975 | Klein | 439/812 |
| 4,114,977 | A | 9/1978 | Polidori | 339/270 |
| 4,303,216 | A | 12/1981 | Hollingsead | 248/74 PB |
| 4,383,668 | A | 5/1983 | Hall | 248/63 |
| 4,428,104 | A | 1/1984 | Smith | 24/279 |
| RE31,689 | E | 10/1984 | Bulanda et al. | 24/16 PB |
| 4,494,024 | A | 1/1985 | Braun | 310/75 A |
| 4,623,204 | A | 11/1986 | Auclair | 439/100 |
| 4,863,390 | A * | 9/1989 | Cera et al. | 439/100 |
| 5,286,211 | A | 2/1994 | McIntosh | 439/100 |
| 5,314,343 | A | 5/1994 | Englander | 439/100 |
| 5,593,327 | A | 1/1997 | Hlinsky et al. | 439/811 |
| 5,616,036 | A | 4/1997 | Polidori | 439/100 |
| 5,632,633 | A | 5/1997 | Roosdorp et al. | 439/100 |
| D389,052 | S | 1/1998 | Yamamoto | D8/396 |
| 5,729,872 | A | 3/1998 | Ginocchio | 24/16 R |
| 5,752,860 | A | 5/1998 | Greaves | 439/781 |
| 5,772,455 | A | 6/1998 | Auclair et al. | 439/100 |
| 5,915,997 | A * | 6/1999 | Lan-Jen | 439/694 |
| 5,934,818 | A * | 8/1999 | Schmitt et al. | 403/399 |
| 5,944,566 | A * | 8/1999 | Gossmann | 439/792 |
| 6,398,596 | B1 | 6/2002 | Malin | 439/800 |
| D473,130 | S | 4/2003 | Leung | D8/396 |
| 6,619,627 | B2 | 9/2003 | Salisbury et al. | 256/1 |
| 6,742,223 | B1 | 6/2004 | Chang | 24/16 R |

(Continued)

*Primary Examiner* — Neil Abrams
(74) *Attorney, Agent, or Firm* — Harrington & Smith

(57) ABSTRACT

An electrical ground connector including a first frame member, a second frame member and a spring. The first frame member has a section with a general hook shape. The general hook shaped section forms a first conductor receiving area adapted to receive a first conductor. The second frame member is slidably connected to the first frame member. The spring biases the second frame member towards the general hook shaped section of the first frame member. The first and/or second frame members form at least one second conductor receiving area adapted to receive a second conductor and locate the second conductor directly against the first conductor in the first conductor receiving area.

18 Claims, 4 Drawing Sheets

U.S. PATENT DOCUMENTS

| | | | | |
|---|---|---|---|---|
| 6,763,555 | B2 | 7/2004 | Storer et al. | 24/274 R |
| 6,986,673 | B2 | 1/2006 | De la Borbolla | 439/100 |
| 7,052,331 | B2 | 5/2006 | Maxwell et al. | 439/758 |
| 7,096,543 | B2 | 8/2006 | Castellanos | 24/16 PB |
| 7,122,739 | B2 | 10/2006 | Franks, Jr. | 174/51 |
| 7,605,331 | B2 * | 10/2009 | Cho | 174/169 |
| 7,666,024 | B2 * | 2/2010 | De France | 439/479 |
| 7,794,243 | B1 * | 9/2010 | Rzasa et al. | 439/100 |
| 7,803,001 | B2 * | 9/2010 | Wason | 439/100 |
| 2008/0194153 | A1 | 8/2008 | DeFrance | 439/822 |
| 2008/0202794 | A1 | 8/2008 | Cho | 174/169 |
| 2010/0144173 | A1 | 6/2010 | Wason | 439/100 |

* cited by examiner

PEDESTAL GROUND CONNECTOR

CROSS REFERENCE TO RELATED APPLICATION

This application claims priority under 35 USC 119(e) on provisional patent application No. 61/276,374 filed Sep. 11, 2009 which is hereby incorporated by reference in its entirety.

BACKGROUND OF THE INVENTION

1. Field of the Invention

The invention relates to a connector and, more particularly, to a spring loaded connector.

2. Brief Description of Prior Developments

Connectors for connecting a ground to a pedestal or post of a raised floor system are known, such as described in U.S. Pat. No. 5,286,211 for example. Spring loaded electrical connectors are also known, such as described in U.S. Patent Application Publication No. 2008/0194153 A1 for example.

SUMMARY

The following summary is merely intended to be exemplary. The summary is not intended to limit the scope of the claimed invention.

In accordance with one aspect of the invention, an electrical connector is provided including a first frame member, a second frame member and a spring. The first frame member has a section with a general hook shape. The general hook shaped section forms a first conductor receiving area adapted to receive a first conductor. The second frame member is slidably connected to the first frame member. The spring biases the second frame member towards the general hook shaped section of the first frame member. The first and/or second frame members form at least one second conductor receiving area adapted to receive a second conductor and locate the second conductor directly against the first conductor in the first conductor receiving area.

In accordance with another aspect of the invention, a connector is provided comprising a first frame member, a second frame member and a spring. The first frame member has a first end and a second end, wherein the first end has a general hook shape forming a raised floor pedestal receiving area and a first ground conductor receiving groove adjacent to the pedestal receiving area. The second frame member is movably connected to the first frame member, wherein the second frame member comprises a second ground conductor receiving groove. The spring biases the second frame member towards the first end of the first frame member such that when a second ground conductor is in the second ground conductor receiving groove and a raised floor pedestal is in the pedestal receiving area, the second ground conductor is biased by the second frame member against the pedestal.

In accordance with another aspect of the invention, a method comprises providing a first frame member comprising a first end having a general hook shape, wherein the general hook shape forms a raised floor pedestal receiving area; movably connecting a second frame member to the first frame member, wherein the second frame member comprises a ground conductor receiving area; and biasing the second frame member towards the pedestal receiving area such that when a ground conductor is in the ground conductor receiving area and a raised floor pedestal is in the pedestal receiving area, the ground conductor is biased by the second frame member against the pedestal.

In accordance with another aspect of the invention, a method comprises locating a connector clamp on a raised floor pedestal wherein a portion of the pedestal is located between a second frame member and a first frame member, wherein the second frame member is movably connected to the first frame member; locating a ground conductor in a ground conductor receiving area of the second frame member; and biasing the second frame member by a spring towards the pedestal receiving area to thereby clamp the ground conductor directly against the pedestal, and to thereby clamp the connector clamp on the pedestal.

BRIEF DESCRIPTION OF THE DRAWINGS

The foregoing aspects and other features of the invention are explained in the following description, taken in connection with the accompanying drawings, wherein.

DETAILED DESCRIPTION OF EMBODIMENT

Figure 1:
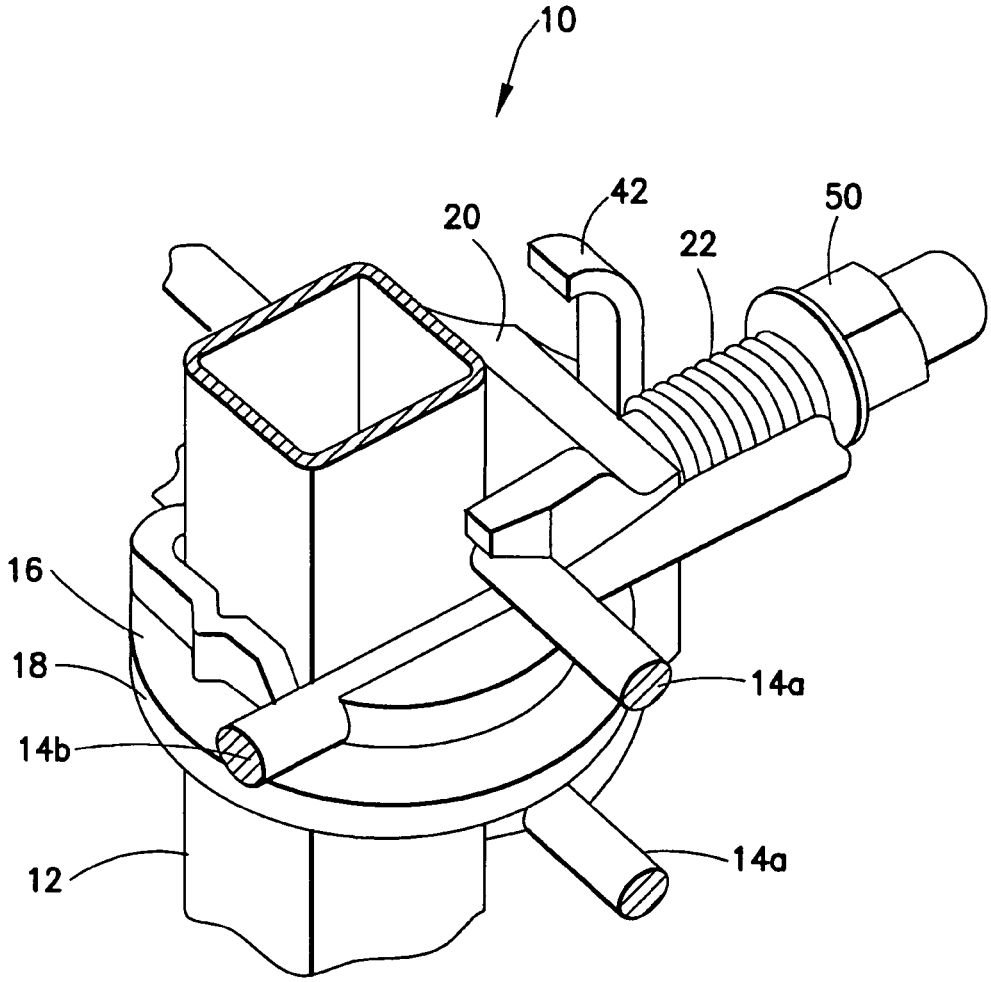
FIG. 1 is a perspective view of a connector comprising features of the invention shown connecting ground conductors onto a pedestal.
Figure 2:
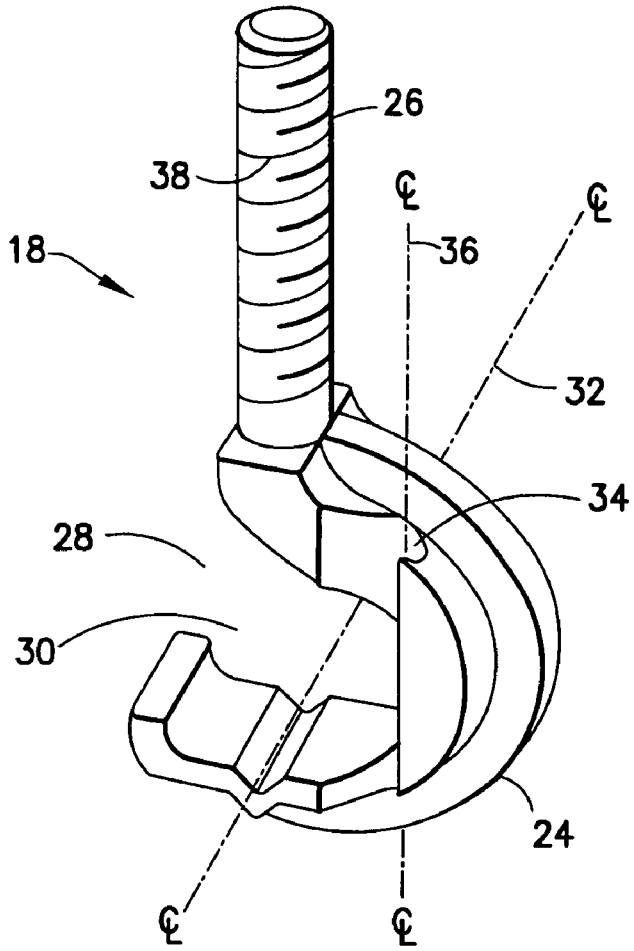
FIG. 2 is a perspective view of a first frame member of the connector shown in FIG. 1.
Figure 3:
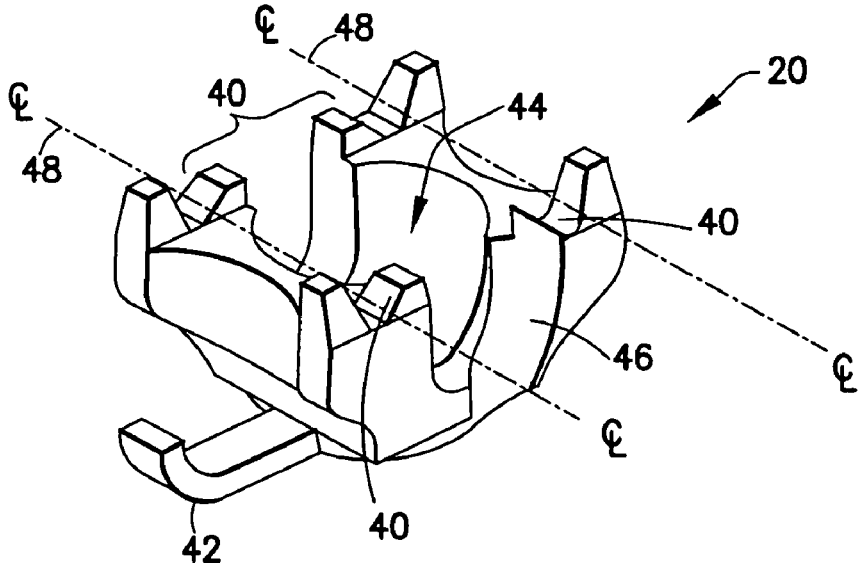
FIG. 3 is a perspective view of a second frame member of the connector shown in FIG. 1.
Figure 4:
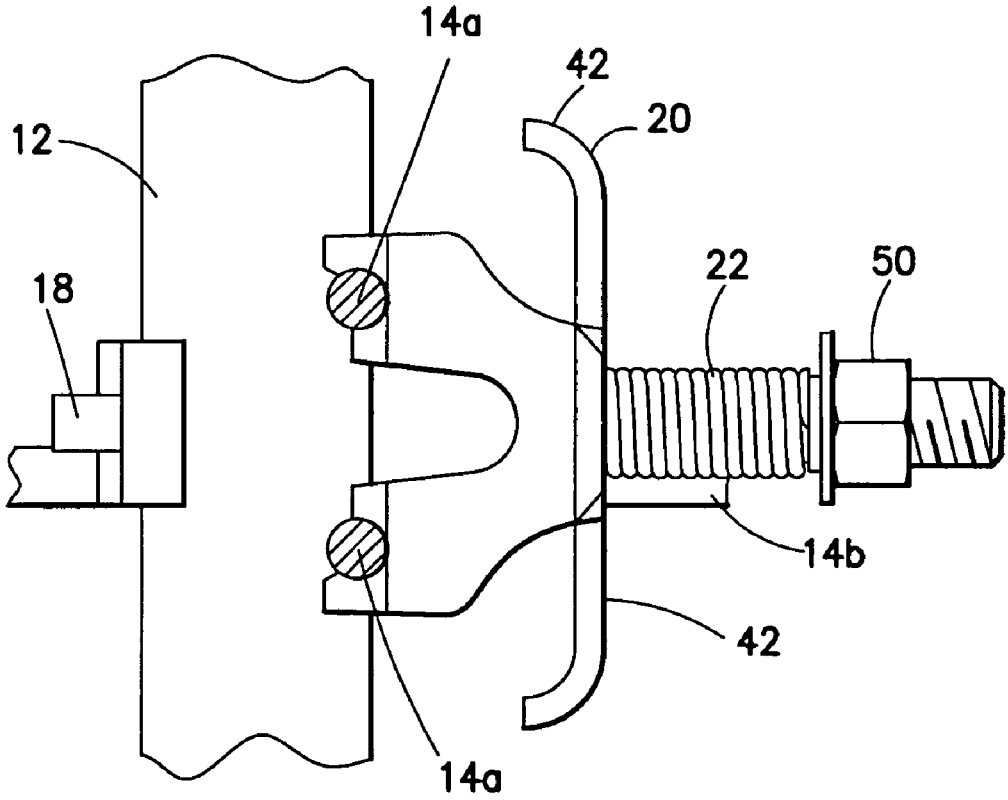
FIG. 4 is a side view of the assembly shown in FIG. 1.
Figure 5:
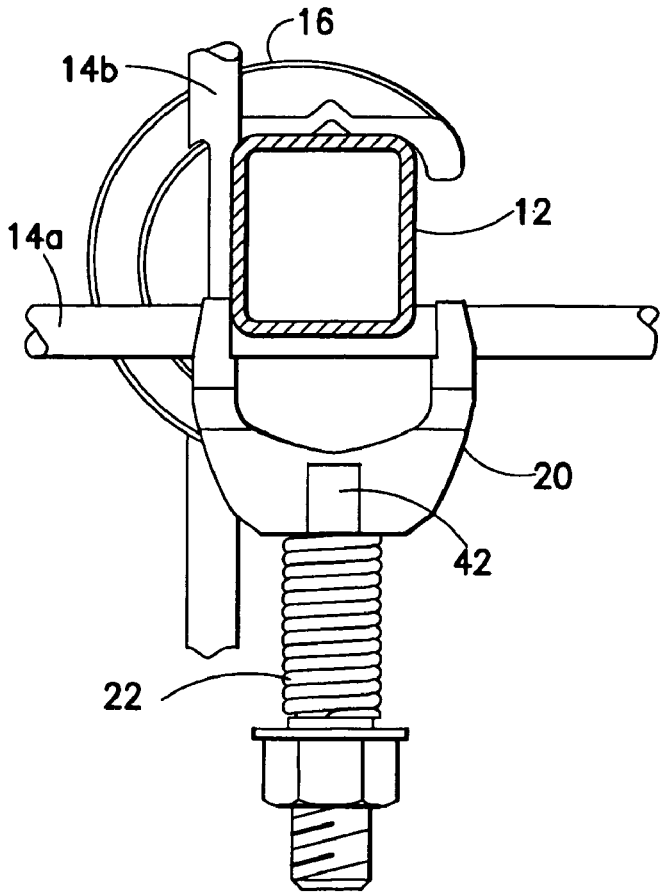
FIG. 5 is a top view of the assembly shown in FIG. 1.
Figure 6:
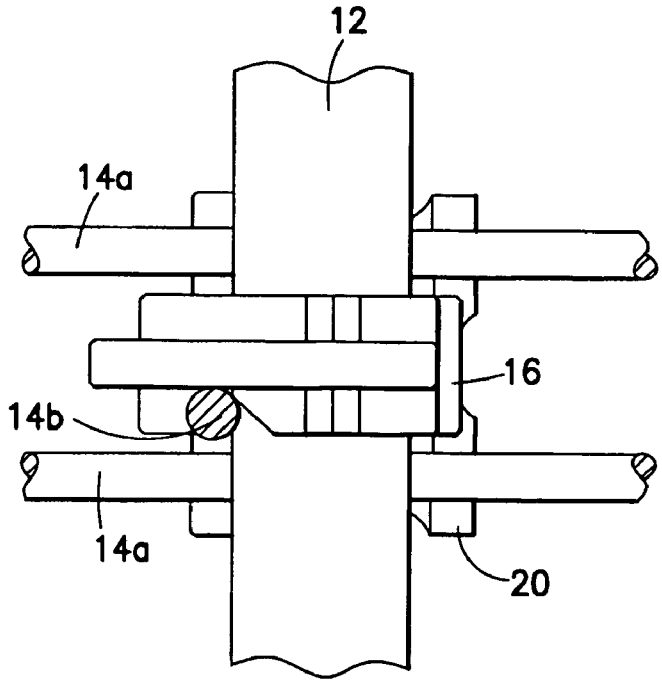
FIG. 6 is another side view of the assembly shown in FIG. 1.

Referring to FIG. 1, there is shown a perspective view of a system 10 incorporating features of the invention. Although the invention will be described with reference to the example embodiment shown in the drawings, it should be understood that the invention can be embodied in many alternate forms of embodiments. In addition, any suitable size, shape or type of elements or materials could be used.

The system 10 provides a connection of a first member 12 with one or more second members 14. In this example embodiment the first member 12 is a pedestal of a raised floor system, such as described in U.S. patent application Ser. Nos. 12/316,472 (now U.S. Pat. No. 7,803,001), 12/380,511 (U.S. Patent Publication no. 2010/0221934), and 12/380,512 (now U.S. Pat. No. 7,794,243) which are hereby incorporated by reference in their entireties. However, the connection could be to any suitable first member. The second members 14 in this example embodiment are electrical ground conductors. The system 10 comprises a connector 16 which functions as a ground connector and is adapted to mechanically and electrically connect the ground conductors 14*a* and/or 14*b* (collectively referred to as 14) on the pedestal 12. Thus, the system forms part of a raised floor grounding system. Features of the invention could be used in an electrical connector which is not a ground connector.

Referring also to FIGS. 2-6, the connector 16 generally comprises a first frame member 18, a second frame member 20 and a spring 22. The first member 16 can be made of electrically conductive material, such as metal. In one example embodiment the first frame member is a one piece member. The first member 16 generally comprises a first end 24 and a second end 26. As seen best in FIG. 2, the first end 24 forms a general hook shaped section. The hook shaped section has an open side 28 into a receiving area 30 with a central axis 32. The receiving area 30 is sized and shaped to receive a portion of the pedestal 12 therein, such as by passing the pedestal through the open side 28. The first end also comprises a conductor receiving groove 34. The groove 34 is adjacent the receiving area 30. In this example embodiment the groove 34 has a central axis 36 which is generally perpendicular to the axis 32. The second end 26 has a general post shape with a threaded section 38.

The hook shaped section of the first end 24 can comprise projections, such as serrations or teeth for example, at the receiving area 30 for piercing through anything on the exterior of the pedestal 12 to thereby make a good electrical contact with the pedestal. For example, serrations (not shown) could be provided to pierce through paint, grease or dirt on the outside surface of the pedestal. Similarly, the second frame 20 and or the grooves 34 and/or 40 could comprise piercing projections for their electrical conductors. In one type of embodiment the serrations or teeth might not be provided, such as when the conductors 14*a*, 14*b* merely need to be electrically connected to each other; not necessarily electrically connected to the pedestal 12. In that example embodiment the connector 16 still functions as a mechanical connector for connecting the conductors 14 to the pedestal at an elevated height on the pedestal 12.

The second frame member 20 is also preferably a one-piece member made of metal for example. As seen best in FIG. 3, the second frame member 20 generally comprises a first side having conductor receiving areas or grooves 40, finger pulls 42 extending outward, a through-hole 44 and a conductor receiving groove 46. The second frame member 20 is slidably mounted onto the second end 26 of the first frame member 18 with the second end 26 extending through the through-hole 44. The first side having the grooves 40 faces towards the pedestal receiving area 30. The groove 46 is aligned with the groove 34. When the second frame member 20 attached to the first frame member 18, central axes 48 of the grooves are orientated generally perpendicular to both the axis 32 and the axis 36.

The spring 22 in this example embodiment comprises a compression coil spring mounted around the post of the second end 26. A first end of the spring 22 is located against the second frame member 20. A fastener 50, such as a threaded nut, is attached to the second end 26 of the first frame member 18. A second end of the spring 22 is located against the fastener 50 to thereby compress the spring 22 between the fastener 50 and the second frame member 20. The spring 22 is, thus, able to bias the second frame member 20 towards the pedestal receiving area 30.

The connector 16 can be used to electrically connect the pedestal 12 to one or more ground conductors 14. In the example embodiment shown, the connector 16 is being used to connect the pedestal 12 to three of the conductors 14. In an alternate embodiment, such as when the pedestal is not electrically conductive, the connector 16 might merely be used to electrically connect two or more of the conductors 14 to each other. The example embodiment shows that the connector 16 can be used to electrically connect two parallel conductors 14*a* to each other and the pedestal, and to the perpendicular conductor 14*b*.

In order to mount the connector 16 onto the pedestal 12, a user can use the finger pulls 42 to pull the second frame member 20 away from the receiving area 30. The spring 22 can compress during this procedure. The pedestal 12 can pass through the open side 28 into the receiving area 30. The user can release the finger pulls 42 and the spring 22 can bias the second frame member 20 towards the receiving area 30 to thereby clamp the pedestal 12 between the first and second frame members 18, 20 in the receiving area 30. This mounts the connector 16 to the pedestal 12. One or more of the ground conductors 14 can be inserted into their respective groove 34, 40 before connection of the connector 16 to the pedestal, or the conductors 14 can be inserted into the grooves 34, 40 after locating the connector 16 on the pedestal.

If the ground conductor 14 is inserted into its respective groove 34, 40 before connection of the connector 16 to the pedestal, the connector 16 will clamp the conductor 14 directly against the pedestal 12 when the user releases the finger pulls 42 and the spring 22 biases the second frame member 20 towards the receiving area 30. If the ground conductor 14 is inserted into its respective groove 34, 40 after connection of the connector 16 to the pedestal, the user can pull the second frame member 20 away from the pedestal 12 (with the spring 22 resiliently compressing), insert the conductor 14 into its respective groove, and release the second frame member 20 again. The spring 22 will bias the second frame member 20 back towards the pedestal thereby clamping the conductor between the pedestal and the second frame member.

The groove 46 could be a tapered groove to wedge and clamp the conductor 14*b* against an end of the groove 34. Thus, the ground conductor 14*b* could be clamped directly between the two frame members 18, 20. Groove 46 could also comprise serrations or teeth (not shown) for insuring good electrical connection with the conductor 14*b* at the groove 46. The two frame members 18, 20 could be sized and shaped to wedge the groove 34 towards the side of the pedestal 12 to thereby clamp the ground conductor 14*b* directly between the pedestal 12 and the first frame member 18.

The invention can provide a spring-loaded raised floor grounding connector with multiple fingers or facets which allow for the installation of one or more conductors with relative ease. The invention can also allow for the installation of conductors in parallel or conductors installed perpendicular to each other as is common in data-center grounding applications. The spring loaded nature of a product comprising the invention can facilitate single-handed installation and ease of conductor insertion, while the hardware on the end of the spring allows for complete compression of the conductors to a pedestal. This can also accommodate round or square pedestals of a predetermined range of sizes.

With the invention, an electrical connector 16 can be provided comprising a first frame member 18, a second frame member 20, and a spring 22. The first frame member 18 can have a section 24 with a general hook shape, wherein the general hook shaped section forms a first conductor receiving area 30 adapted to receive a first conductor 12. The second frame member 20 can be slidably connected to the first frame member 18. The spring 22 can bias the second frame member 20 towards the general hook shaped section 24 of the first frame member 18. The first and/or second frame members form at least one second conductor receiving area 34, 40 adapted to receive a second conductor 14 and locate the second conductor directly against the first conductor 12 in the first conductor receiving area 30.

With the invention, a method can be provided comprising providing a first frame member 18 comprising a first end 24 having a general hook shape, wherein the general hook shape forms a raised floor pedestal receiving area 30; movably connecting a second frame member 20 to the first frame member 18, wherein the second frame member comprises a ground conductor receiving area 40; and biasing the second frame member 20 towards the pedestal receiving area 30 such that when a ground conductor 14*a* is in the ground conductor receiving area 40 and a raised floor pedestal 12 is in the pedestal receiving area 30, the ground conductor 14*a* is biased by the second frame member against the pedestal.

In another method of the invention, a method can be provided comprising locating a connector clamp 16 on a raised floor pedestal 12 wherein a portion of the pedestal 12 is located between a second frame member 20 and a first frame member 18, wherein the second frame member 20 is movably connected to the first frame member 18; locating a ground conductor 14*a* in a ground conductor receiving area 40 of the second frame member 20; and biasing the second frame member by a spring 22 towards the pedestal receiving area 30 to thereby clamp the ground conductor 14*a* directly against the pedestal 12, and to thereby clamp the connector clamp 16 on the pedestal 12. Locating the connector clamp on the raised floor pedestal can comprise pulling the second frame member away from the pedestal receiving area by pulling on finger pulls 42 on the second frame member 20.

In one example embodiment of the invention an electrical connector 16 comprising a first frame member 18, a second frame member 20, and a spring 22. The first frame member 18 can have a section 24 with a general hook shape, wherein the general hook shaped section forms a first conductor receiving area 30 adapted to receive a first conductor. The second frame member 20 is slidably connected to the first frame member 18. The spring 22 biasing the second frame member 20 towards the general hook shaped section 24 of the first frame member 18. The first and/or second frame members form at least one second conductor receiving area 34 and/or 40 adapted to receive a second conductor and locate the second conductor directly against the first conductor in the first conductor receiving area 30.

The first section 24 of the first frame member can comprise one of the second conductor receiving areas comprising a conductor receiving groove 34 which is located adjacent to the first conductor receiving area. The conductor receiving groove 34 can have a central axis 36 generally perpendicular to a central axis 32 of the first conductor receiving area. The hook shaped section can be at a first end of the first frame member, wherein the electrical connector can further comprises a fastener connected to a second end 26 of the first frame member, and wherein the spring can be a compression spring located between the fastener and the second frame member. The second end 26 of the first frame member can comprise a threaded rod section, wherein the fastener 50 can comprise a nut screwed onto the threaded rod section, and wherein the spring can comprise a coil spring mounted around the threaded rod section. The second frame member can comprise two of the second conductor receiving areas 40 located on opposite sides of a through-hole 44 through the second frame member. The two second conductor receiving areas 40 can have central axes 48 which are generally parallel to each other and generally perpendicular to a central axis 32 of the first conductor receiving area. The first section 24 of the first frame member can comprise one of the second conductor receiving areas comprising a conductor receiving groove 34 which is located adjacent to the first conductor receiving area. The conductor receiving groove 34 can have a central axis 36 generally perpendicular to the central axis 32 of the first conductor receiving area, and generally perpendicular to the central axes 48 of the two second conductor receiving areas of the second frame member. The second frame member can comprise finger pulls 42 extending from the second frame member.

In one example embodiment of the invention a connector can comprise a first frame member 18, a second frame member 20 and a spring 22. The first frame member can have a first end 24 and a second end 26, wherein the first end has a general hook shape forming a raised floor pedestal receiving area 30 and a first ground conductor receiving groove 34 adjacent to the pedestal receiving area. The second frame member 20 can be movably connected to the first frame member, wherein the second frame member comprises a second ground conductor receiving groove 40. The spring 22 can bias the second frame member 20 towards the first end 24 of the first frame member such that when a second ground conductor is in the second ground conductor receiving groove 40 and a raised floor pedestal is in the pedestal receiving area 30, the second ground conductor is biased by the second frame member against the pedestal.

The first ground conductor receiving groove can have a central axis 36 generally perpendicular to a central axis 32 of the pedestal receiving area. The connector can further comprise a fastener 50 connected to the second end 26 of the first frame member, and the spring 22 can be a compression spring located between the fastener 50 and the second frame member 20. The second end 26 of the first frame member can comprise a threaded rod section 38, wherein the fastener 50 can comprise a nut screwed onto the threaded rod section, and wherein the spring 22 can comprise a coil spring mounted around the threaded rod section. The second frame member can comprises two of the second ground conductor receiving grooves 40 located on opposite sides of a through-hole 44 through the second frame member. The two second ground conductor receiving grooves 40 can have central axes 48 which are generally parallel to each other and generally perpendicular to a central axis 30 of the pedestal receiving area, wherein the first ground conductor receiving groove 34 can have a central axis 36 generally perpendicular to the central axis of the pedestal receiving area, and generally perpendicular to the central axes of the two second ground conductor receiving grooves of the second frame member. The second frame member can comprise finger pulls 42 extending from the second frame member.

A method can comprise providing a first frame member 18 comprising a first end 24 having a general hook shape, wherein the general hook shape forms a raised floor pedestal receiving area 30; movably connecting a second frame member 20 to the first frame member, wherein the second frame member comprises a ground conductor receiving area 40; and biasing the second frame member 20 towards the pedestal receiving area 30 such that when a ground conductor 14*a* is in the ground conductor receiving area 34 and a raised floor pedestal 12 is in the pedestal receiving area 30, the ground conductor is biased by the second frame member against the pedestal.

A method can be provided comprising locating a connector clamp 16 on a raised floor pedestal 12 wherein a portion of the pedestal is located between a second frame member 20 and a first frame member 18, wherein the second frame member is movably connected to the first frame member; locating a ground conductor 14*a* in a ground conductor receiving area 40 of the second frame member; and biasing the second frame member by a spring 22 towards the pedestal receiving area 30 to thereby clamp the ground conductor 14*a* directly against the pedestal 12, and to thereby clamp the connector clamp on the pedestal. The method can comprise locating the connector clamp on the raised floor pedestal comprises pulling the second frame member away from the pedestal receiving area by pulling on finger pulls 42 on the second frame member.

A feature of an example embodiment of the invention is the ability to install the connector 16 on the pedestal 12 with one hand. The space available to an installer under a pedestal raised flood system is very limited; perhaps between only one to two feet for example. Therefore, the ability for the installer to install the connector 16 with only one hand is very useful. The installer can merely place his thumb on the tip of the second end 26 and fingers on the finger pulls 42 to compress the spring 22 and move the second frame 20 away from the receiving area 30. Once the pedestal 12 is in the receiving area 30 the user can release the finger pulls 42 and allow the spring 22 to clamp the pedestal 12 between the two frame members 18, 20. The conductors 14 can be located in the connector 16 before or after the connector 16 is mounted to the pedestal 12.

In one type of example embodiment, the connector 16 could be sold to the installer as a preassembled assembly with the frame members 18, 20, the spring 22 and the fastener 50 connected to each other. In another type of example embodiment the components 18, 20, 22, 50 could be sold to the installer disassembled, perhaps with some having different shapes, such that the installer can assembly the components into the assembly; perhaps with customized selection of different size or shaped components 18, 20, 22, 50.

The spring loaded nature of the connector can also allow for a unique type of installation of the connector 16 to the pedestal. The user/installer can snap the connector 16 onto the square or round pedestal pipe. This snapping action can allow the serrations or teeth to pierce through any dirt or grease or paint on the exterior of the pedestal. Thus, the installation can have a spring propelled snap of the connector on the pedestal to insure a good electrical connection of the pedestal with the connector 16. However, a snapping installation does not need to be used.

It should be understood that the foregoing description is only illustrative of the invention. Various alternatives and modifications can be devised by those skilled in the art without departing from the invention. For example, features recited in the various dependent claims could be combined with each other in any suitable combination(s). In addition, features from different embodiments described above could be selectively combined into a new embodiment. Accordingly, the invention is intended to embrace all such alternatives, modifications and variances which fall within the scope of the appended claims.

What is claimed is:

1. An electrical connector comprising:

a first frame member having a first section with a general hook shape, wherein the general hook shaped section forms a first conductor receiving area adapted to receive a first conductor;

a second frame member slidably connected to the first frame member; and a spring biasing the second frame member towards the general hook shaped first section of the first frame member, wherein the first and/or second frame members form at least one second conductor receiving area adapted to receive a second conductor and locate the second conductor directly against the first conductor in the first conductor receiving area, wherein the first section of the first frame member comprises one of the second conductor receiving areas comprising a conductor receiving groove which is located adjacent to the first conductor receiving area.

2. An electrical connector as in claim 1 wherein the conductor receiving groove has a central axis generally perpendicular to a central axis of the first conductor receiving area.

3. An electrical connector comprising:

a first frame member having a first section with a general hook shape, wherein the general hook shaped section forms a first conductor receiving area adapted to receive a first conductor;

a second frame member slidably connected to the first frame member; and a spring biasing the second frame member towards the general hook shaped first section of the first frame member, wherein the first and/or second frame members form at least one second conductor receiving area adapted to receive a second conductor and locate the second conductor directly against the first conductor in the first conductor receiving area, wherein the hook shaped first section is at a first end of the first frame member, wherein the electrical connector further comprises a fastener connected to a second end of the first frame member, and wherein the spring is a compression spring located between the fastener and the second frame member.

4. An electrical connector as in claim 3 wherein the second end of the first frame member comprises a threaded rod section, wherein the fastener comprises a nut screwed onto the threaded rod section, and wherein the spring comprises a coil spring mounted around the threaded rod section.

5. An electrical connector as in claim 1 wherein the second frame member comprises finger pulls extending from the second frame member.

6. An electrical connector comprising:

first frame member having a first section with a general hook shape, wherein the general hook shaped section forms a first conductor receiving area adapted to receive a first conductor;

a second frame member slidably connected to the first frame member; and a spring biasing the second frame member towards the general hook shaped first section of the first frame member, wherein the first and/or second frame members form at least one second conductor receiving area adapted to receive a second conductor and locate the second conductor directly against the first conductor in the first conductor receiving area, wherein the second frame member comprises two of the second conductor receiving areas located on opposite sides of a through-hole through the second frame member.

7. An electrical connector as in claim 6 wherein the two second conductor receiving areas have central axes which are generally parallel to each other and generally perpendicular to a central axis of the first conductor receiving area.

8. An electrical connector as in claim 7 wherein the first section of the first frame member comprises one of the second conductor receiving areas comprising a conductor receiving groove which is located adjacent to the first conductor receiving area.

9. An electrical connector as in claim 8 wherein the conductor receiving groove has a central axis generally perpendicular to the central axis of the first conductor receiving area, and generally perpendicular to the central axes of the two second conductor receiving areas of the second frame member.

10. A connector comprising:

a first frame member having a first end and a second end, wherein the first end has a general hook shape forming a raised floor pedestal receiving area and a first ground conductor receiving groove adjacent to the pedestal receiving area;

a second frame member movably connected to the first frame member, wherein the second frame member comprises a second ground conductor receiving groove;

a spring biasing the second frame member towards the first end of the first frame member such that when a second ground conductor is in the second ground conductor receiving groove and a raised floor pedestal is in the pedestal receiving area, the second ground conductor is biased by the second frame member against the pedestal; and a fastener connected to the second end of the first frame member, and wherein the spring is a compression spring located between the fastener and the second frame member.

11. A connector as in claim 10 wherein the first ground conductor receiving groove has a central axis generally perpendicular to a central axis of the pedestal receiving area.

12. A connector as in claim 10 wherein the second end of the first frame member comprises a threaded rod section, wherein the fastener comprises a nut screwed onto the threaded rod section, and wherein the spring comprises a coil spring mounted around the threaded rod section.

13. A connector as in claim 10 wherein the second frame member comprises finger pulls extending from the second frame member.

14. A connector comprising:

a first frame member having a first end and a second end, wherein the first end has a general hook shape forming a raised floor pedestal receiving area and a first ground conductor receiving groove adjacent to the pedestal receiving area;

a second frame member movably connected to the first frame member, wherein the second frame member comprises a second ground conductor receiving groove; and a spring biasing the second frame member towards the first end of the first frame member such that when a second ground conductor is in the second ground conductor receiving groove and a raised floor pedestal is in the pedestal receiving area, the second ground conductor is biased by the second frame member against the pedestal, wherein the second frame member comprises two of the second ground conductor receiving grooves located on opposite sides of a through-hole through the second frame member.

15. A connector as in claim 14 wherein the two second ground conductor receiving grooves have central axes which are generally parallel to each other and generally perpendicular to a central axis of the pedestal receiving area, wherein the first ground conductor receiving groove has a central axis generally perpendicular to the central axis of the pedestal receiving area, and generally perpendicular to the central axes of the two second ground conductor receiving grooves of the second frame member.

16. A method comprising:

providing a first frame member comprising a first end having a general hook shape, wherein the general hook shape forms a raised floor pedestal receiving area;

movably connecting a second frame member to the first frame member, wherein the second frame member comprises a ground conductor receiving area;

biasing the second frame member towards the pedestal receiving area such that when a ground conductor is in the ground conductor receiving area and a raised floor pedestal is in the pedestal receiving area, the ground conductor is biased by the second frame member against the pedestal; and connecting a fastener to a second end of the first frame member, where biasing the second frame member towards the pedestal receiving area comprises a compression spring being located between the fastener and the second frame member.

17. A method comprising:

locating a connector clamp on a raised floor pedestal wherein a portion of the pedestal is located between a second frame member and a first frame member, wherein the second frame member is movably connected to the first frame member;

locating a ground conductor in a ground conductor receiving area of the second frame member;

biasing the second frame member by a spring towards the pedestal receiving area to thereby clamp the ground conductor directly against the pedestal, and to thereby clamp the connector clamp on the pedestal, connecting a fastener to a second end of the first frame member; and where biasing the second frame member towards the pedestal receiving area comprises the spring being located between the fastener and the second frame member.

18. A method as in claim 17 wherein locating the connector clamp on the raised floor pedestal comprises pulling the second frame member away from the pedestal receiving area by pulling on finger pulls on the second frame member.

* * * * *